US005410964A

United States Patent [19]

Koelsch

[11] Patent Number: 5,410,964

[45] Date of Patent: May 2, 1995

[54] LEAD EDGE STRIP

[75] Inventor: Kevin W. Koelsch, Toledo, Ohio

[73] Assignee: Dynamic Dies, Inc., Holland, Ohio

[21] Appl. No.: 154,496

[22] Filed: Nov. 19, 1993

[51] Int. Cl.[6] ..... B41F 27/06

[52] U.S. Cl. ..... 101/378; 101/382.1; 101/383; 101/408; 101/415.1

[58] Field of Search ..... 101/378, 382.1, 383, 101/384, 408, 407.1, 409, 415.1, 486

[56] References Cited

U.S. PATENT DOCUMENTS

| | | | |
|---|---|---|---|
| 3,387,559 | 6/1968 | Horner | 101/378 |
| 3,675,573 | 7/1972 | Hawks | 101/378 |
| 3,946,670 | 3/1976 | Cerny et al. | 101/378 |
| 4,090,444 | 5/1978 | Stearns | 101/378 |
| 4,932,324 | 6/1990 | Pinkston et al. | 101/415.1 |
| 5,127,327 | 7/1992 | Philpot | 101/378 |

*Primary Examiner*—Edgar S. Burr
*Assistant Examiner*—Lynn Hendrickson
*Attorney, Agent, or Firm*—Willian Brinks Hofer Gilson & Lione

[57] ABSTRACT

A lead edge strip for securing one edge of a flexographic carrier sheet provides improved strength and mounting stability and thus printing accuracy. The edge strip comprises a base portion, a pair of parallel walls extending from said base portion and a short lip for engaging a complementary overhanging edge of a flexographic printing plate cylinder. The carrier sheet is received between the parallel walls and secured there by suitable fastening means. Preferably, the lead edge strip is transparent as this facilitates mounting of the lead edge strip and carrier sheet upon the printing cylinder. The lead edge strip in combination with a carrier sheet is also taught.

20 Claims, 1 Drawing Sheet

LEAD EDGE STRIP

BACKGROUND OF THE INVENTION

The invention relates generally to devices for providing a secure, engageable lip on the edge of sheet material and more specifically to a lead edge strip for securement to a printing plate carrier sheet which includes a lip complementary to and engageable with an overhanging edge on a printing cylinder.

Flexographic printing, also known as flexography or aniline printing, is a generally preferred printing process for large areas such as containers and cardboard cartons, point of purchase displays and the like. Flexographic printing is relief, i.e., direct, printing utilizing large plates fastened to a rotating cylinder. It is capable of producing an image with exceptional clarity and contrast. A single inking roller supplied with aniline ink from rollers in the ink fountain provides ink to raised, image forming printing plates disposed on the rotating cylinder which print directly upon the product. The carrier sheet or mounting material which carries the printing plate or plates may be several inches on each side or several feet. The carrier sheet is mounted to the printing plate cylinder at one edge by cooperation between a lip on the lead edge of the carrier sheet and a complementarily configured channel and undercut lip on the cylinder. The opposite edge of the carrier sheet is secured to the plate cylinder by one, or typically a plurality of, elastic straps which retain the carrier sheet upon the plate cylinder and properly tension it.

Since the elastic mounting straps merely provide tension to the carrier sheet to retain it upon the printing plate cylinder, it is apparent that the location and the registration of the carrier sheet and thus of the print plate disposed thereon is almost exclusively the result of cooperation between the leading edge strip of the carrier sheet and the complementary lip on the printing plate cylinder. Since the printing plate cylinder is most generally fabricated of metal, it may be considered dimensionally stable and may thus be virtually ruled out as a source of variability and error when installing and utilizing flexographic printing plates. However, since the carrier sheet and its mounting edge are relatively lightweight, correct mounting and stability are concerns with regard to same. Accordingly, significant attention has been directed to the mounting method and configuration of carrier sheets and mounting edge.

SUMMARY OF THE INVENTION

A lead edge strip for securing one edge of a flexographic carrier sheet provides improved strength and mounting stability and thus printing accuracy. The edge strip comprises a generally triangular base portion, a pair of parallel walls extending from said base portion and a short lip for engaging a complementary overhanging edge of a flexographic printing plate cylinder, The carrier sheet is received between the parallel walls and secured there by suitable fastening means.

The angled lower surface of the triangular base portion facilitates installation of the edge strip in the channel of a printing cylinder. Furthermore, the lead edge strip is preferably transparent as this also facilitates mounting of the lead edge strip and carrier sheet upon a printing cylinder. The lead edge strip is preferably extruded polyvinyl chloride (PVC).

The lead edge strip according to the present invention is also disclosed and claimed in combination with a printing carrier sheet. The edge strip may be utilized in any application requiring a secure, engageable lip disposed along an edge of diverse sheet material.

Thus it is an object of the present invention to provide an engageable strip for securement to an edge of sheet material.

It is a further object of the present invention to provide a novel lead edge structure for a carrier sheet for flexographic printing.

It is a still further object of the present invention to provide a lead edge strip which includes a pair of parallel ribbons or edges to which a carrier sheet may be secured.

It is a still further object of the present invention to provide a lead edge strip with improved strength and rigidity which facilitates positive securement of a carrier sheet to a flexographic printing drum.

It is a still further object of the present invention to provide a lead edge strip which is transparent and thus facilitates proper disposition of an associated carrier sheet upon a flexographic printing drum.

Further objects and advantages of the present invention will become apparent by reference to the following description of the preferred embodiment and appended drawings.

DESCRIPTION OF THE PREFERRED EMBODIMENT

Figure 1:
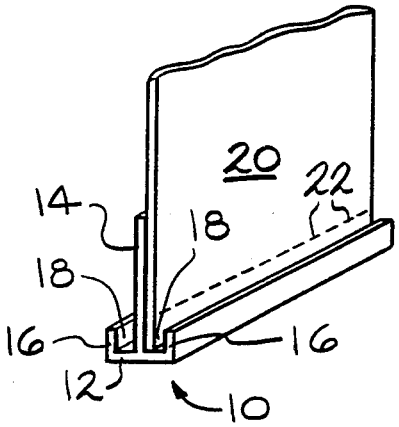
FIG. 1 PRIOR ART
FIG. 1 is a perspective view of a prior art leading edge strip attached to a carrier sheet.

Referring now to FIG. 1, a prior art lead edge strip is illustrated and generally designated by the reference numeral 10. The prior art lead edge strip 10 may be conveniently described as a T with serifs which is inverted in the illustration. The prior art lead edge strip 10 is symmetrical and defines a bottom portion 12 which is integrally formed with a centrally disposed web 14 which is perpendicular to the bottom portion 12. Disposed parallel to the central web 14 and equally spaced therefrom are a pair of symmetrical ears 16. Between each of the ears 16 and the central web 14 is a channel 18 having a width substantially greater than the thickness of a carrier sheet 20. The carrier sheet 20 is secured to the central web 14 by stitching or staples 22. The prior art lead edge strip 10 is an extrusion of opaque plastic material.

Figure 2:
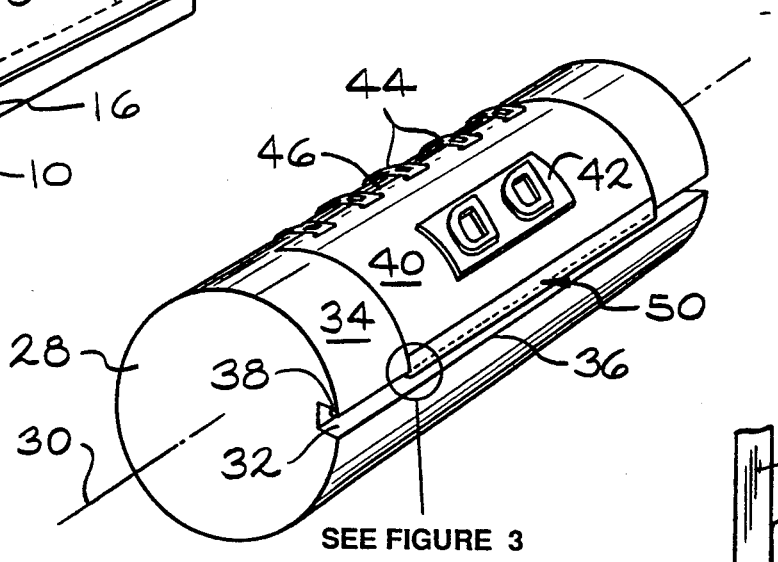
FIG. 2 is a diagrammatic, perspective view of a flexographic printing cylinder having a carrier sheet secured thereto by a lead edge strip according to the present invention.

Referring to FIG. 2, a flexographic printing cylinder 28 is diagrammatically illustrated. The printing cylinder 28 is disposed for clockwise rotation about a center axis 30 when viewed from the left end as illustrated in FIG. 2. The flexographic printing cylinder 28 includes an undercut or L-shaped kerf or channel 32 which extends generally across its full width. One wall of the channel 32 and the outer surface 34 of the printing cylinder 28 define a substantially right angle corner 36. The channel 32 also defines an overhanging or undercut edge or lip 38 spaced from and disposed parallel to the corner 36.

Disposed about and conforming to the outer surface 34 of the printing cylinder 28 is a carrier sheet 40. The carrier sheet 40 includes a printing plate 42 which is illustrative and representative of any and all types of text, diagrams, drawings and pictures, for example, which may be disposed upon and attached to a carrier sheet 40. The carrier sheet 40 may be secured to the printing cylinder 28 by a plurality of elastic straps 44 which extend from and are coupled to the carrier sheet 40 adjacent a rear edge 46. The elastic straps 44 are secured to the printing cylinder 28 by suitable means (not illustrated). At the opposite, leading edge of the carrier sheet 40 is a lead edge strip 50.

Figure 3:
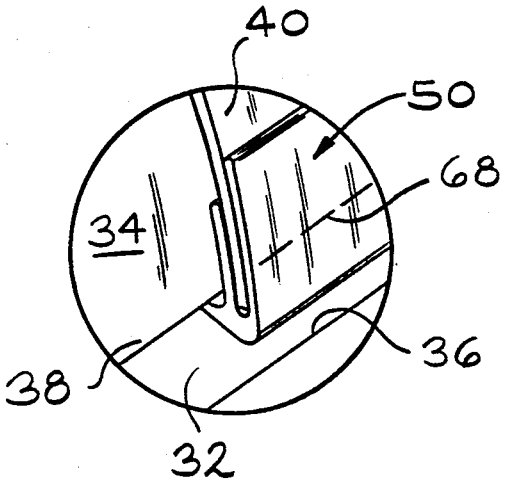
FIG. 3 is an enlarged, perspective view of a lead edge strip according to the present invention.
Figure 4:
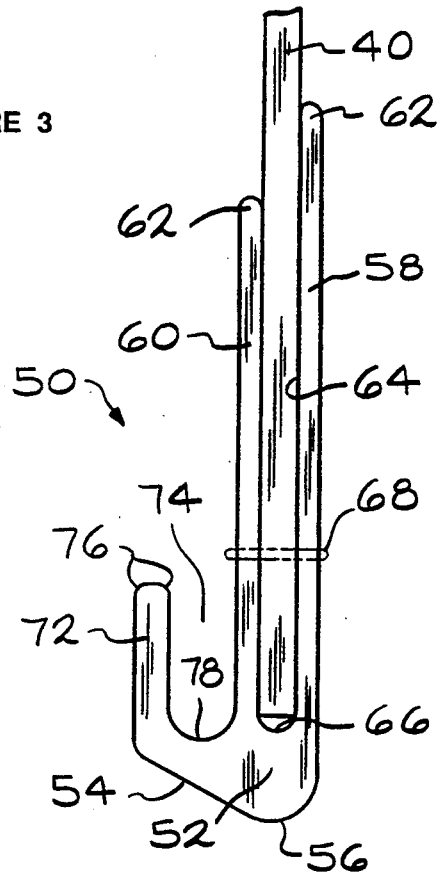
FIG. 4 is a greatly enlarged, side, elevational view of a lead edge strip according to the present invention secured to a carrier sheet.

Referring now to FIGS. 3 and 4, the lead edge strip 50 according to the present invention defines an asymmetrical structure having a base portion 52 which is generally triangular and defines an oblique lower surface 54 merging with a radiused nose portion 56. The oblique lower surface 54 is preferably disposed at a large acute angle of between about 60° and 65° relative to the body of the strip 50. So oriented, the lower surface 54 facilitates mounting the lead edge strip 50 fully and securely within the channel 32 of the printing cylinder 28 by cooperating with the corner 36 of the channel 32 opposite the edge or lip 38.

Generally proximate and extending away from the nose portion 56 are a pair of unequal length panels or walls 58 and 60. A first, longer, outer wall 58 defines an outer edge of the lead edge strip 50. A second, shorter, middle wall 60 is parallel to and is spaced from the first, outer wall 58 a distance substantially equal to or just slightly greater than the thickness of the carrier sheet 40. Each of the walls 58 and 60 define radiused, semi-circular terminal portions 62.

The walls 58 and 60 define a first slot 64 which receives the carrier sheet 40. The bottom of the first slot 64, that is, that portion immediately adjacent the base portion 52 defines a curved, semi-circular wall portion 66. The semi-circular wall portion 66 serves to distribute forces acting on the lead edge strip 50 thereby inhibiting cracking and improving its service life. The carrier sheet 40 is received within the first slot 64 and is secured to the walls 58 and 60 of the lead edge strip 50 by stitching or staples 68 or other securement means such as an adhesive or autogenous bonding achieved by the application of RF or IR radiation, heat or ultrasonic energy. The lengths of the first, longer wall 58 and the second, shorter wall 60 are, as illustrated, different. This configuration provides a flat surface (the inner surface of the first, longer wall 58) adjacent the end of the shorter, middle wall 60 which advantageously acts as a guide and facilitates insertion of the carrier sheet 40 into the slot 64.

Adjacent the thinner portion of the triangular base portion 52 and opposite the first wall 58 is a foreshortened wall, projection or lip 72. The projection or lip 72 is preferably somewhat thicker than the walls 58 and 60. The second, middle wall 60 and the retaining lip 72 define a second, relatively wide slot 74. The second slot 74 is generally complementary to and is intended to receive the overhanging or undercut edge 38 of the printing cylinder 28.

The end of the short projection or lip 72 also defines radiused corners 76 thereby eliminating sharp edges. Also, the bottom of the second slot 74 defines a curved, semi-circular wall portion 78 which also serves to distribute forces acting on the lead edge strip 50, thereby inhibiting cracking and extending its service life.

The lead edge strip 50 typically defines a height of approximately 0.8 inches (20.5 mm.) and a thickness of approximately 0.25 inches (6.3 mm.). The second, middle wall 60 is approximately 0.1 inches (2.6 mm.) shorter than the first, outer wall 58. The length of the short projection or lip 72 is approximately 0.15 inches (3.9 mm.) and is thus approximately one third to one fourth the length of the walls 58 and 60. The walls 58 and 60 are approximately 0.03 inches (0.76 mm.) thick and the lip 72 is somewhat thicker, approximately 0.04 inches (1.02 mm.). The first slot 64 defined by the walls 58 and 60 is approximately 0.05 inches (1.2 mm.) wide and the second slot 74 is approximately twice as wide, 0.09 inches (2.3 mm.).

Preferably, the lead edge strip 50 is fabricated by extrusion from a transparent, rugged plastic material such as virgin polyvinyl chloride (PVC). While the lead edge strip 50 may be fabricated of an opaque material, transparent materials are preferable since they have the distinct advantage of permitting visual checks of the proper mounting and registration of the lip 72 on the undercut edge 38 and thus proper mounting of the carrier sheet 40 and the printing plate 42 on the printing cylinder 28. As an extrusion, it will be appreciated that the lead edge strip 50 may be produced in continuous lengths which may be cut to any convenient length for shipment and further trimmed or cut to match the width of the carrier sheet 40 to which it is secured.

While described herein with general reference to carrier sheets for flexographic printing, it should be appreciated that the lead edge strip of the present invention will find broad application in those areas requiring a secure engageable lip disposed along an edge of sheet material to facilitate mounting or securement of such material to associated equipment or complementary structure.

The foregoing disclosure is the best mode devised by the inventor for practicing this invention. It is apparent, however, that apparatus incorporating modifications and variations will be obvious to one skilled in the art of printing. Inasmuch as the foregoing disclosure is intended to enable one skilled in the pertinent art to practice the instant invention, it should not be construed to be limited thereby but should be construed to include such aforementioned obvious variations and be limited only by the spirit and scope of the following claims.

I claim:

1. A edge strip for disposition upon a sheet comprising, in combination, a generally triangular base portion having a middle, two opposed edge regions and an end surface extending obliquely between said two edge regions, a pair of parallel walls extending generally from said middle and one of said edge regions of said base portion, said parallel walls defining a first slot therebetween for receiving a sheet, and a projection extending from the other of said edge regions of said base portion, said projection being shorter and thicker than either of said pair of walls and spaced from a more proximate one of said pair of parallel walls to define a second slot wider than said first slot.

2. The edge strip of claim 1 wherein said first slot defines a width substantially equal to or slightly greater than a sheet.

3. The edge strip of claim 1 wherein said walls are of unequal length.

4. The edge strip of claim 1 wherein said projection is approximately one-quarter to one-third as long as said parallel walls.

5. The edge strip of claim 1 wherein said projection is generally parallel to said pair of parallel walls.

6. The edge strip of claim 1 wherein the ends of said parallel walls opposite said base portion are rounded.

7. The edge strip of claim 1 wherein the portions of said first and second slots adjacent said base portion define curved walls.

8. The edge strip of claim 1 wherein said end surface is disposed at a large acute angle to said pair of parallel walls.

9. The edge strip of claim 1 which is fabricated of transparent polyvinyl chloride.

10. The edge strip of claim 1 wherein said one of said edge regions of said base portion defines a thickness greater than said other of said edge regions of said base portion.

11. A lead edge strip for disposition upon a carrier sheet comprising, in combination, a base portion having a first region, a second region and an obliquely oriented end surface defined by said regions, said first region defining a thickness greater than said second region, a pair of parallel walls extending from said first region of said base portion, said parallel walls defining a sheet receiving space therebetween, and a projection extending from said second region of said base portion, said projection being shorter and thicker than either of said pair of walls and spaced from said more proximate one of said pair of parallel walls to define a slot wider than said sheet receiving space adapted to receive a lip of a printing cylinder.

12. The lead edge strip of claim 11 wherein said space defines a width substantially equal to or slightly greater than a carrier sheet.

13. The lead edge strip of claim 11 wherein said walls are of unequal length.

14. The lead edge strip of claim 11 wherein said projection is approximately one-quarter to one-third as long as said parallel walls.

15. The lead edge strip of claim 11 wherein regions of said slot and said sheet receiving space adjacent said base portion define curved walls.

16. A carrier sheet assembly comprising, in combination, carrier sheet means for disposition on a printing cylinder, a lead edge strip having a generally triangular base portion having a first region, a second region and an obliquely oriented end surface defined by said first and said second regions, a pair of walls extending from said base portion, said walls defining a space for receiving said carrier sheet therebetween, means for securing said carrier sheet within said space, and a projection extending from said base portion, said projection being shorter and thicker than either of said pair of walls and spaced from said more proximate one of said pair of walls to define a slot wider than said space adapted to receive a lip of a printing cylinder.

17. The carrier sheet assembly of claim 16 wherein said first region defines a thickness greater than said second region and wherein said walls extend from said first region.

18. The carrier sheet assembly of claim 16 wherein said means for securing is stitching or staples.

19. The carrier sheet assembly of claim 16 wherein said lead edge strip is transparent polyvinyl chloride.

20. The carrier sheet assembly of claim 16 wherein said pair of walls are parallel, of unequal length and thinner than said projection.

* * * * *